US012364895B2

(12) United States Patent
Peter

(10) Patent No.: US 12,364,895 B2
(45) Date of Patent: Jul. 22, 2025

(54) ROLLING EXERCISE DEVICE

(71) Applicant: Adrian Peter, Rockledge, FL (US)

(72) Inventor: Adrian Peter, Rockledge, FL (US)

(73) Assignee: Adrian Peter, Rockledge, FL (US)

( * ) Notice: Subject to any disclaimer, the term of this patent is extended or adjusted under 35 U.S.C. 154(b) by 181 days.

(21) Appl. No.: 18/455,742

(22) Filed: Aug. 25, 2023

(65) Prior Publication Data

US 2025/0065173 A1 Feb. 27, 2025

(51) Int. Cl.
*A63B 21/012* (2006.01)
*A63B 21/00* (2006.01)

(52) U.S. Cl.
CPC .... *A63B 21/0125* (2013.01); *A63B 21/00069* (2013.01); *A63B 21/4035* (2015.10)

(58) Field of Classification Search
CPC ..... A63B 21/00069; A63B 21/005; A63B 21/0056; A63B 21/0057; A63B 21/0058; A63B 21/0125; A63B 21/015; A63B 21/023; A63B 21/4033; A63B 21/4034; A63B 21/4035; A63B 21/4049; A63B 24/0087; A63B 2220/17; A63B 2220/51; A63B 2220/833; A63B 2225/50; A63B 2225/74
See application file for complete search history.

(56) References Cited

U.S. PATENT DOCUMENTS

| | | | | |
|---|---|---|---|---|
| 5,707,325 | A * | 1/1998 | Chiou | A63B 22/20 482/127 |
| 7,175,573 | B1 * | 2/2007 | Huang | A63B 21/0004 446/236 |
| 8,894,555 | B2 * | 11/2014 | Colledge | A63B 23/14 482/118 |
| 9,649,521 | B2 * | 5/2017 | Miller | A63B 71/0036 |
| 9,808,665 | B1 * | 11/2017 | Demarais | A63B 21/4035 |
| 10,265,563 | B2 * | 4/2019 | Miller | A61H 15/0092 |
| 10,549,150 | B2 * | 2/2020 | Chen | A63B 21/025 |
| 10,843,033 | B1 * | 11/2020 | Sotis | A63B 23/0211 |
| 11,944,871 | B2 * | 4/2024 | Singer | A63B 24/0087 |
| 2002/0123416 | A1 * | 9/2002 | Huang | A63B 22/20 482/140 |

(Continued)

FOREIGN PATENT DOCUMENTS

| | | | | |
|---|---|---|---|---|
| CN | 204073267 U | * | 1/2015 | A63B 21/4035 |
| CN | 207708415 U | * | 8/2018 | |

(Continued)

*Primary Examiner* — Gary D Urbiel Goldner
(74) *Attorney, Agent, or Firm* — Daniel C. Pierron; Widerman Malek PL

(57) ABSTRACT

An exercise device includes an axial member, a rotating apparatus, a variable resistance apparatus, and two handle assemblies. The axial member defines a center axis of a central assembly of the exercise device. The rotating apparatus is configured to rotate about the center axis and includes a surface interfacing member, a hub positioned around the axial member, and a plurality of spokes. The variable resistance apparatus includes a resistance member that exerts resistance to the rotation of the rotating apparatus, and a user control device operable to change a magnitude of resistance exerted by the variable resistance member. The two handle assemblies are positioned on opposite sides of the hub.

20 Claims, 7 Drawing Sheets

(56) References Cited

U.S. PATENT DOCUMENTS

| | | | | |
|---|---|---|---|---|
| 2012/0157274 | A1* | 6/2012 | MacColl | A63B 21/00185 482/132 |
| 2013/0017936 | A1* | 1/2013 | Olson | A63B 21/4049 482/132 |
| 2015/0182792 | A1* | 7/2015 | MacColl | A63B 22/20 482/132 |
| 2015/0328491 | A1* | 11/2015 | Miller | A63B 21/4025 482/121 |
| 2017/0080271 | A1* | 3/2017 | Miller | A63B 21/00043 |
| 2019/0151708 | A1* | 5/2019 | Chen | A63B 71/0619 |
| 2020/0023233 | A1* | 1/2020 | Skaroupka | A63B 21/00185 |
| 2021/0197018 | A1* | 7/2021 | Duran | A63B 21/4039 |
| 2023/0112877 | A1* | 4/2023 | Chuah | A63B 24/0062 482/132 |
| 2024/0009521 | A1* | 1/2024 | Singer | A63B 24/0087 |

FOREIGN PATENT DOCUMENTS

| | | | | |
|---|---|---|---|---|
| CN | 110812789 | A | * | 2/2020 |
| KR | 200265377 | Y1 | * | 2/2002 |
| KR | 20220001160 | U | * | 5/2022 |

* cited by examiner

ROLLING EXERCISE DEVICE

FIELD OF THE INVENTION

The present invention relates to a rolling exercise device that may be used for exercising abdominal muscles.

SUMMARY OF THE INVENTION

With the above in mind, embodiments of the present invention are related to an abdominal exercise device comprising a central assembly that comprises an axial member defining a center axis of the central assembly. The axial member comprises a proximal end, a distal end, and openings at each of the first and second ends. The central assembly further comprises a rotating apparatus configured to rotate about a comprising a surface interfacing member configured to rotate about the center axis relative to the axial member, a hub positioned around the axial member, and a plurality of spokes extending from the hub to the surface interfacing member. The device further comprises a variable resistance apparatus comprising a resistance member configured to exert resistance to the rotation of the rotating apparatus about the axial member and a user control device operable to change the magnitude of resistance exerted by the resistance member. The device further comprises two handle assemblies positioned on opposite sides of the hub, each handle assembly comprising an intermediate member comprising a first end attached to one of the proximal and distal ends of the axial member and a second end. The handle assemblies each further comprise a handle member attached to the intermediate member at the second end and configured to facilitate a user to use with the abdominal exercise device.

In some embodiments, the variable resistance apparatus may further comprise a brake plate positioned on a distal side of the hub and positioned such that the rotating apparatus rotates with respect to the brake plate and a spring positioned on a proximal side of the hub and operable to exert an axial force on the hub. The user control device may be operable to selectively compress the spring to change the magnitude of the axial force exerted by the spring on the hub. The rotating apparatus may further comprise a brake plate interfacing surface configured to interface with the brake plate and have a frictional force exerted thereon by the brake plate, resisting the rotation of the rotating apparatus. In some further embodiments, the abdominal exercise device may further comprise a first bearing positioned between the spring and the hub configured to permit the hub to rotate with respect to the spring while enabling the exertion of the axial force by the spring upon the hub.

In some embodiments, the user control device may comprise a body member configured to be manipulated by the user a threaded aperture. The proximal end of the axial member may comprise threads configured to engage with the threads of the threaded aperture. Manipulation of the body member by the user causes the threaded aperture to rotate with respect to the axial member, causing axial movement of the body member along the center axis, thereby causing a change in the compression of the spring. In some further embodiments, the body member may comprise a recess and the threaded aperture is defined by a nut positioned within the recess of the body member such that rotation of the body member causes rotation of the nut. The variable resistance apparatus may further comprise a second bearing positioned adjacent to and distal of the nut and configured to interface with a surface of the nut, a washer positioned adjacent to and distal of the second bearing, and a third bearing positioned adjacent to and distal of the washer. The spring may interface with the third bearing, and the second bearing, the washer, and the third bearing enable the compression of the spring by the axial movement of the nut while permitting rotation of the nut about the center axis at least partially independent of the spring.

In some further embodiments, the abdominal exercise device may further comprise a sensor positioned on a distal side of the central assembly and a measuring member configured to interface with a structure on the proximal side of the central assembly on a first end thereof and interact with the sensor on a second end thereof. The first end of the measuring member may be axially translated by the movement of the body member and the movement of the first end of the measuring member may cause an effect in the second end of the measuring member that is detectable by the sensor. The abdominal exercise device may further comprise a controller positioned in communication with the sensor and an indicator device positioned in communication with the controller. The sensor may be a pressure sensor comprising a pressure sensing surface and be configured to transmit a signal to the controller responsive to a measured pressure on the pressure sensing surface. The second end of the measuring member may be configured to interface with a surface of the pressure sensor and exert a force thereon. The magnitude of the force exerted by the measuring member on the pressure sensor changes with the axial translation of the first end of the measuring member. The controller may be configured to calculate a calculated resistance being exerted on by the variable resistance apparatus responsive to the signal received from the pressure sensor and operate the indicator device to provide an indication of the calculated resistance.

In some embodiments the user control device may further comprise a user input interface configured to receive a user input selecting a desired resistance, an electromechanical device operable to compress the spring, and a controller coupled to each of the user input interface and the electromechanical device. The controller may be operable to receive the user input from the user input interface, determine a spring compression amount responsive to the user input, and operate the electromechanical device to compress the spring to the spring compression amount. In some further embodiments, the user control device may further comprise a body member configured to be manipulated by the electromechanical device and a threaded aperture. The proximal end of the axial member may comprise threads configured to engage with the threads of the threaded aperture. Manipulation of the body member by the electromechanical device may cause the threaded aperture to rotate with respect to the axial member, causing axial movement of the body member along the center axis, thereby causing a change in the compression of the spring. In some embodiments, the electromechanical device may be a linear actuator configured to selectively compress the spring along the central axis.

In some embodiments, the surface interfacing member may comprise an interior surface structure connected to the spokes and an outer surface member attached to and supported by the interior surface structure and formed of a rubber material.

In some embodiments, the resistance member may comprise an electric motor having a rotor configured to engage with the hub, the electric motor being operable to exert a force on the hub via the rotor to resist rotation of the hub and a power source configured to provide power to the electric motor to enable operation of the electric motor. The user control device may comprise a user interface operable to control the operation of the electric motor.

In some embodiments, the handle member may be a first handle member configured to be removably attached at the second end and to facilitate the user grasping the first handle member, the abdominal exercise device further comprising a second handle member configured to be removably attached at the second end and to support a foot of the user.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 1:
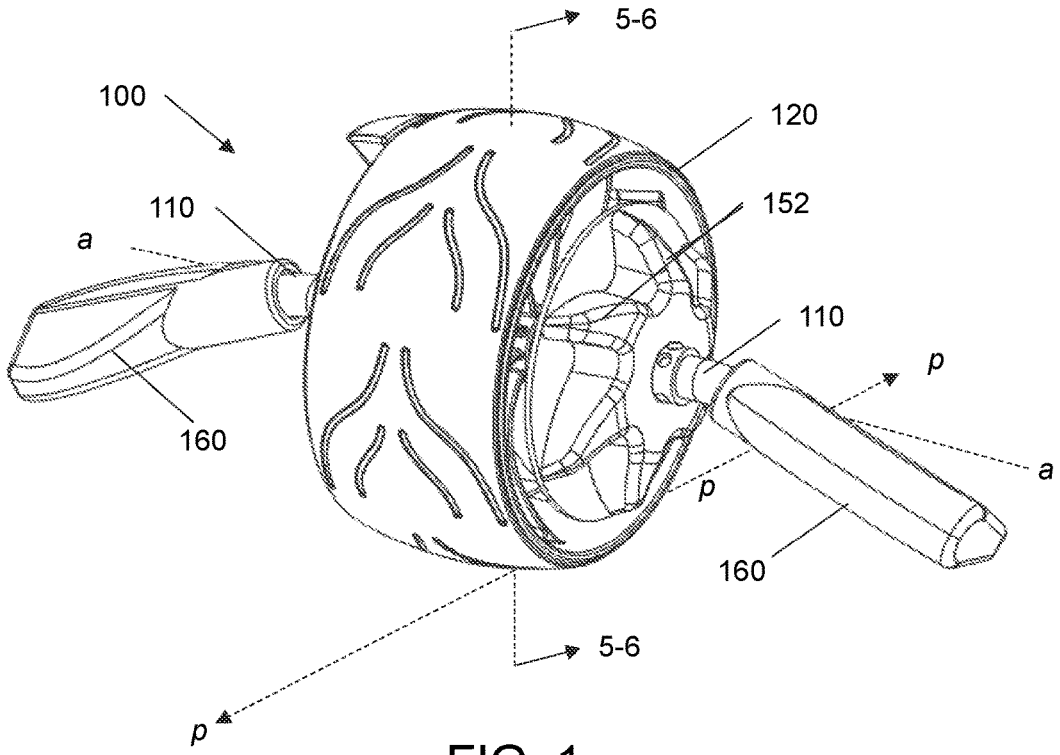
FIG. 1 is front perspective view of an abdominal exercise device according to an embodiment of the invention.
Figure 2:
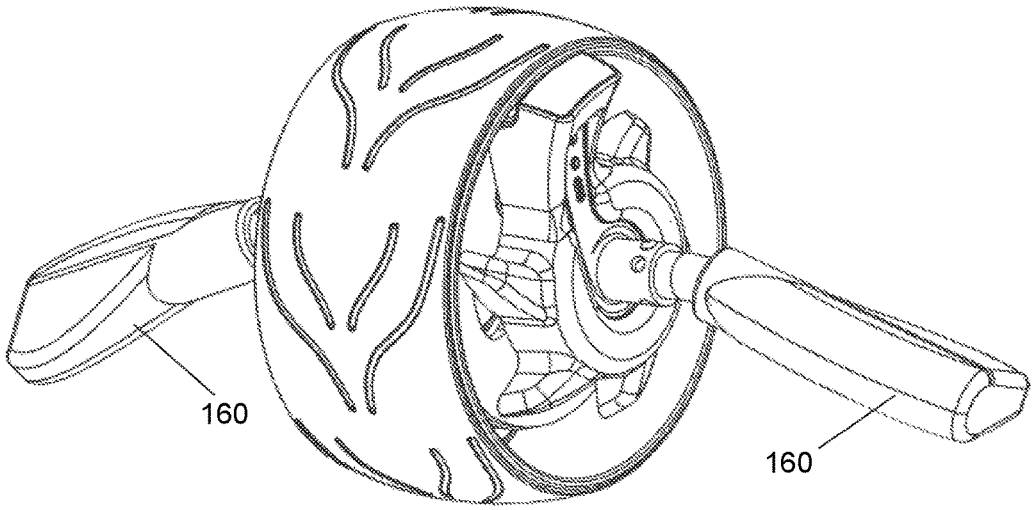
FIG. 2 is a rear perspective view of the abdominal exercise device of FIG. 1.
Figure 3:
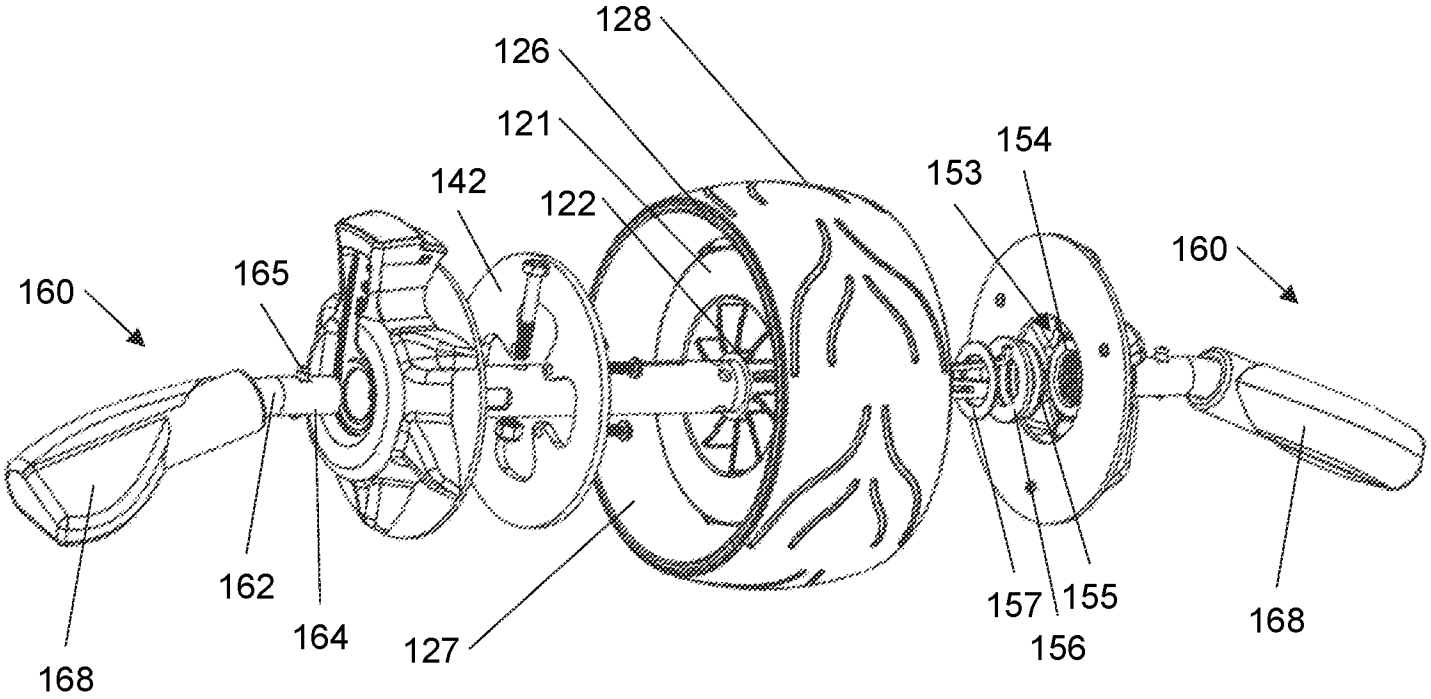
FIG. 3 is a front perspective exploded view of the abdominal exercise device of FIG. 1.
Figure 4:
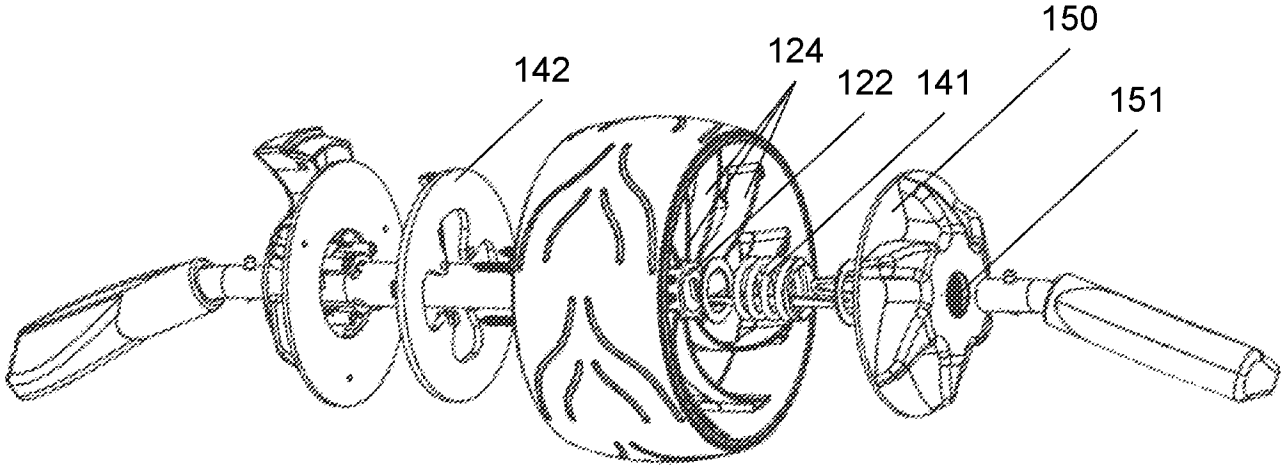
FIG. 4 is a rear perspective exploded view of the abdominal exercise device of FIG. 1.
Figure 5:
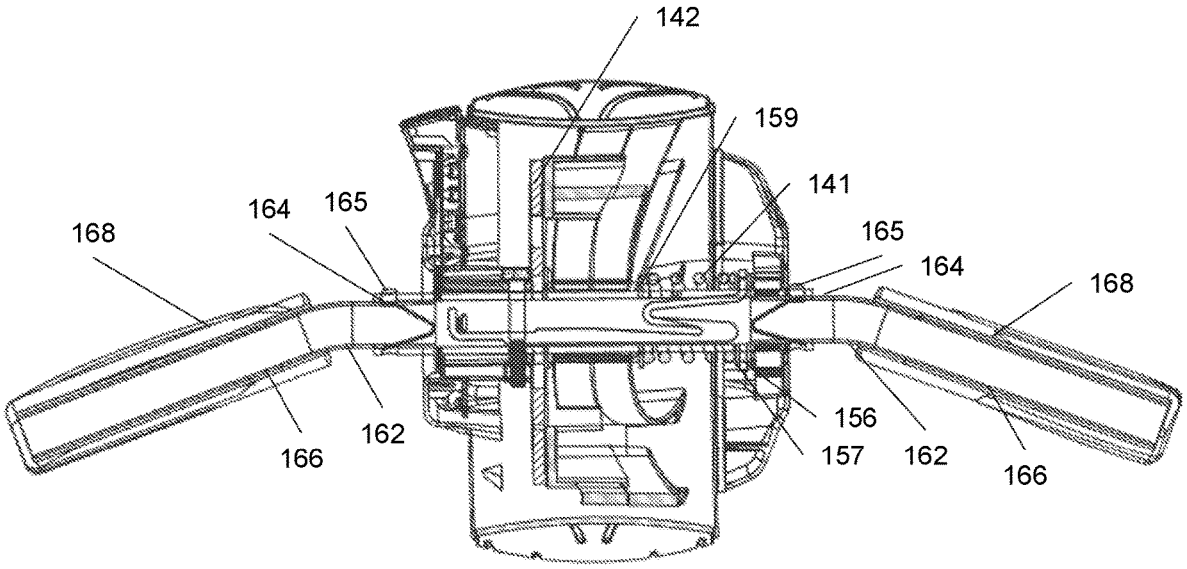
FIG. 5 is a front sectional view of the abdominal exercise device of FIG. 1 along 5-6.
Figure 6:
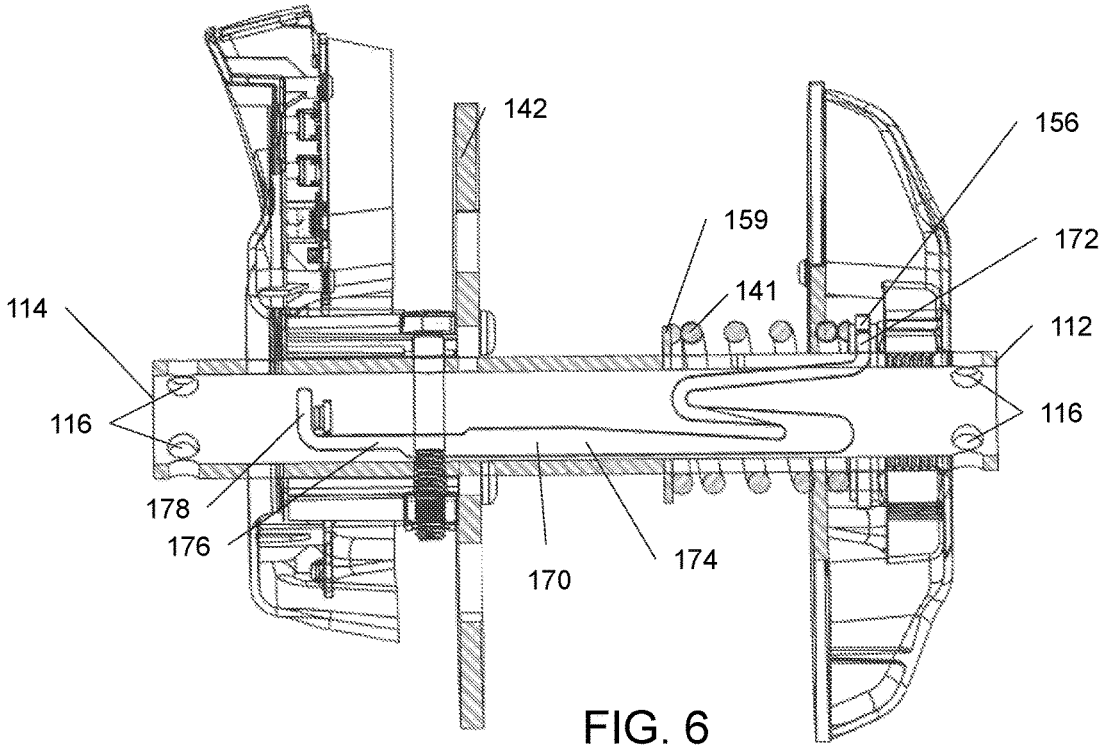
FIG. 6 is a front partial sectional view of the abdominal exercise device of FIG. 1 along 5-6

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides an abdominal exercise device. Referring now to FIGS. 1-9, an abdominal exercise device 100 according to an embodiment of the invention is presented. The abdominal exercise device 100 may comprise a central assembly comprising an axial member 110 and a rotating apparatus 120, a variable resistance apparatus 140, and a pair of opposing handle assemblies 160. The axial member 110 may define a rotational axis a about which the rotating apparatus 120 may rotate. The opposing handle assemblies 160 may be attached at each end of the axial member 110 and may provide an interface for the user to either grasp with their hands or place their hands or feet upon. The user may exercise with the device 100 by rolling forward and backward along path p. The variable resistance apparatus 140 may apply resistance to the rotating apparatus 120 to inhibit its rotation about axis a. Axis a may define the center axis of the axial member 110. As the amount of resistance applied by the variable resistance apparatus 140 increases, the amount of force exerted by the user to roll the device 100 along path p also increases, thereby increasing the difficulty and effectiveness of exercising with the device 100.

The axial member 110 may be a tubular structure having a proximal end 112 and a distal end 114. The axial member 110 may have openings at each of the proximal and distal ends 112, 114 to facilitate the releasable attachment of the handle assemblies 160 at each end (see FIG. 6). Additionally, each of the proximal and distal ends 112, 114 may comprise a plurality of apertures 116 to further facilitate the releasable attachment of the handle assemblies 160 thereto, for example, by permitting depressible retaining structures comprised by the handle assemblies to be positioned therethrough. The axial member may define a longitudinal channel within which other parts of the device 100 may be positioned, as will be discussed in greater detail below.

The rotating apparatus 120 may be configured to rotate about center axis of the axial member 110, axis a. The rotating apparatus 120 may comprise a hub 122 positioned to circumscribe and may generally circumscribe the axial member 110. In some embodiments, the hub 122 may be positioned at a center point along the length of the axial member 110. In some embodiments, the lengths of parts of the axial member 110 extending from either side of the hub 122, i.e. extending proximally and distally, respectively, may be equal in length.

The rotating apparatus 120 may further comprise a plurality of spokes 124 extending outward from the hub 122. In the present embodiment, the plurality of spokes 124 extend outward from the hub 122 while also arcing such that the plurality of spokes 124 do not extend radially outward but have a curvature. Other embodiments may have a plurality of spokes 124 that extend radially outward or a different type of curvature.

In some embodiments, the plurality of spokes 124 may be integrally formed with the hub 122 as a single integral member. In some embodiments, the plurality of spokes 124 may be attached to the hub 122 by any means or method as is known in the art, including, but not limited to, welding, adhesives, fasteners, and the like.

Figure 7:
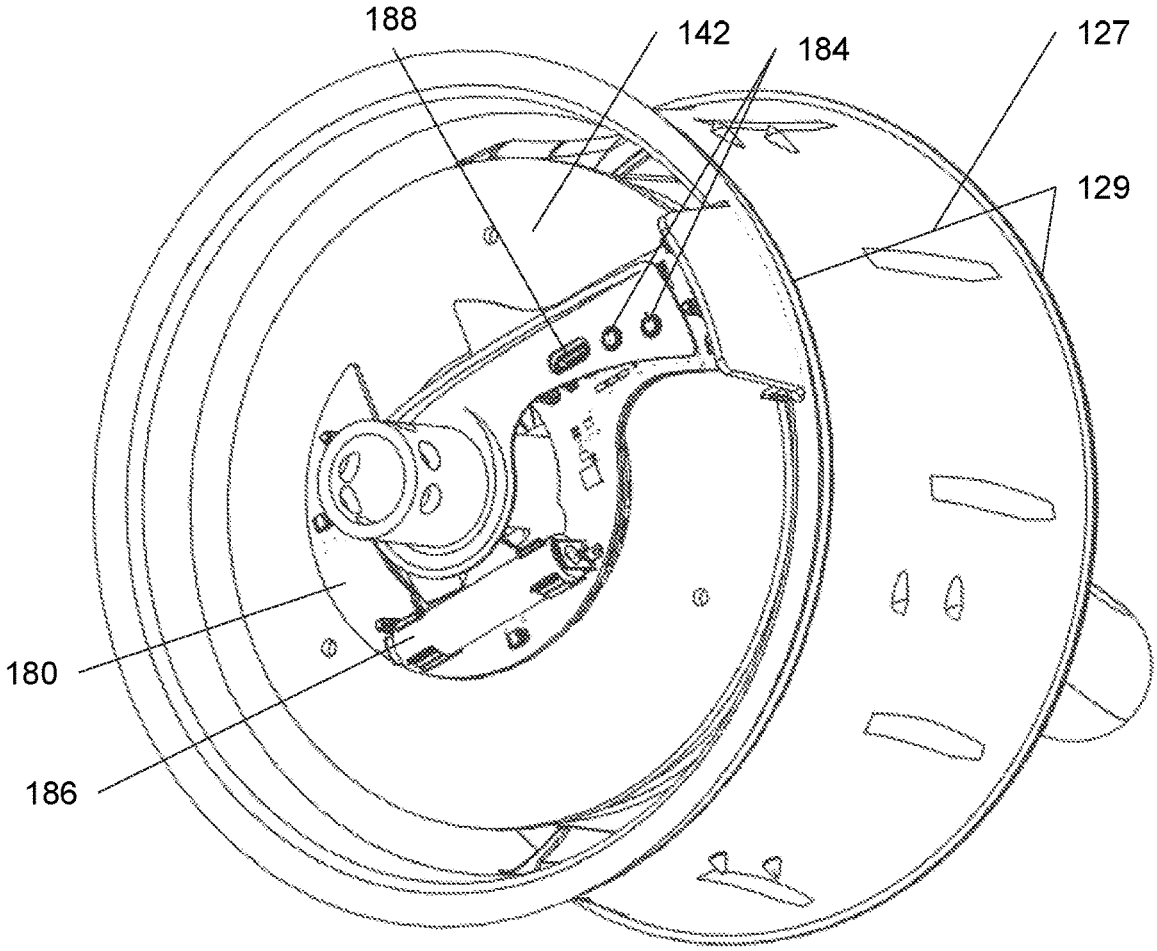
FIG. 7 is a partial perspective view of the abdominal exercise device of FIG. 1.
Figure 8:
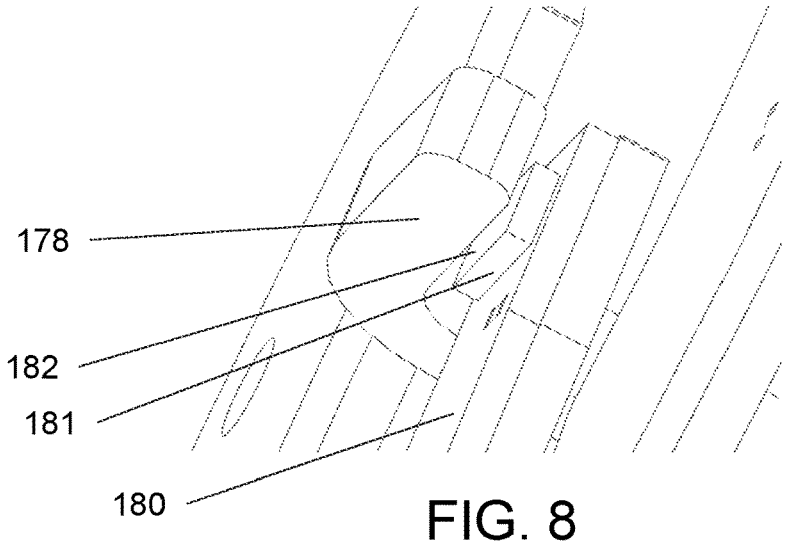
FIG. 8 is a perspective view of a sensor device and a portion of a measurement member of the abdominal exercise device of FIG. 1.

The rotating apparatus 120 may further comprise a surface interfacing member 126. The surface interfacing member 126 may be configured to be attached to the plurality of spokes 124 and interface with a surface in the environment within which the device 100 is used. The surface interfacing member 126 may comprise an interior surface structure 127 and an outer surface member 128. The interior surface structure 127 may be the part of the surface interfacing member 126 configured to attach to the plurality of spokes 124. Such attachment may be accomplished by any means or method as is known in the art, including those described above. In some embodiments, the interior surface structure 127 and the plurality of spokes 124 may be integrally formed as a single structure. In some further embodiments, the hub 122, the plurality of spokes 124, and the interior surface structure 127 may be integrally formed as a single structure. As shown in FIG. 7, the interior surface structure 127 may have a concave shape and may comprise a plurality of features configured to facilitate attachment of the outer surface member 128 and/or prevent slippage of the outer surface member 128 relative to the interior surface structure 127. The interior surface structure 127 may further comprise ridges 129 configured to prevent the outer surface member 128 from coming off the edge of the interior surface structure 127.

The outer surface member 128 may be configured to interface with a surface in the environment, for example, the floor. Moreover, the outer surface member 128 may be configured to prevent itself from slipping across the surface of the floor, instead gripping the surface and causing the rotating apparatus 120 to rotate as the device 100 moves across the floor. Accordingly, the outer surface member 128 may be formed of a material with a coefficient of friction sufficient to generally prevent or avoid such sliding and instead cause the rotating apparatus 120 to rotate as the device moves across a surface. Such materials may include, but are not limited to, rubber, latex, other elastomers including synthetic rubber, and the like. The outer surface member 128 may be affixed to an outer surface of the interior surface structure 127 by any means or method as is known in the art, including, but not limited to, adhesives, fasteners, rivets, interference fits, retention structures, and the like.

As mentioned above, the variable resistance apparatus 140 may be configured to exert a variable amount of resistance on the rolling apparatus to change the amount of force necessary for the user to exert to roll the device 100 across a surface. The variable resistance apparatus 140 may comprise a resistance member configured to exert said resistance on the rotating apparatus 120, and a user control device operable to change the magnitude of resistance exerted by the variable resistance apparatus 140. In the present embodiment, the variable resistance apparatus 140 may be configured to press the rotating apparatus 120 against a brake plate so as to resist the rotation of the rotating apparatus 120. The variable resistance apparatus 140 may comprise a spring 141 to exert the force against the rotating apparatus 120 and a brake plate 142 which may interface with a surface of the rotating apparatus 120 to exert a frictional force thereon, restraining the rotation of the rotating apparatus 120. The spring 141 may be positioned on one side of the hub 122 and the brake plate 142 may be positioned on an opposite side of the hub 122. In the present embodiment, the spring 141 is positioned on a proximal side of the hub 122 and the brake plate 142 is positioned on a distal side of the hub 122. In such embodiments, the rotating apparatus 120 may further comprise a brake plate interfacing surface 121 configured to interface with the brake plate 142 and have a frictional force exerted thereupon by the brake plate 142. The frictional force exerted by the brake plate 142 may scale with the force exerted by the spring 141 on the rotating apparatus 120, such that as the force exerted by the spring 141 increases, the frictional force resisting rotation of the rotating apparatus 120 exerted by the brake plate 142 on the brake plate interfacing surface 121 may also increase. Conversely, as the force exerted by the spring 141 decreases, the frictional force resisting rotation of the rotating apparatus 120 exerted by the brake plate 142 on the brake plate interfacing surface 121 may also decrease.

The spring 141 may be positioned to exert an axial force on an element of the rotating apparatus 120 as described above. Such an axial force may be in the direction opposite the side of the hub 122 on which the spring 141 is positioned. In the present embodiment, the axial force may be exerted in a distal direction. The spring 141 may exert this force on any structure of the rotating apparatus 120 as may tolerate such forces. In this embodiment, the force may be exerted upon the hub 122. In some embodiments, the spring 141 may directly interface with the hub 122. In the present embodiment, the device 100 may further comprise a first bearing 159 positioned between a distal end of the spring 141 and a proximal end of the hub 122. The first bearing 159 may be configured to transmit the axial force exerted upon it by the spring 141 to the hub 122 while enabling the spring 141 to rotate with respect to the hub 122 and without damaging the surface of the hub 122.

As mentioned above, the variable resistance apparatus 140 may comprise a user control device operable to change the magnitude of resistance exerted by the variable resistance apparatus 140. In the present embodiment, the user control device may be operable to permit a user to change the amount of axial force exerted by the spring 141 on the hub 122, thereby changing the frictional resistance of the brake plate 142 on the brake plate interfacing surface 121. The user control device of the present embodiment may comprise a body member 150 configured to be manipulated by a user and a threaded aperture 151. The threaded aperture may be configured to engage with threads of another structure of the device 100 to enable the user to rotate the body member 150 and thereby translate the body member 150 along the longitudinal axis a proximally and distally, resulting in axial movement of the body member 150. Such translation may result from the threaded engagement of the threaded aperture 151 and cause the compression and release of spring 141, thereby changing the force the spring 141 exerts on the hub 122. The body member 150 may further comprise one or more engagement structures 152 configured to facilitate the user gripping the body member 150 and rotating it as described above. In the present embodiment, the proximal end of the axial member 110 may comprise threads configured to engage with the threaded aperture 151. The threaded aperture 151 may be positioned at approximately the center of the body member 150.

The body member 150 may further comprise a recess 153. The threaded aperture 151 may be positioned such that a distal opening thereof opens into the recess 153. In some embodiments, the threaded aperture 151 may be defined by a nut 154 positioned withing the recess 153 such that rotation of the body member 150 may cause rotation of the nut 154. The threaded engagement of the nut 154 with the threads of the axial member 110 may cause proximal and distal axial movement of the nut.

The variable resistance apparatus 140 may further comprise a second bearing 155. The second bearing 155 may be positioned adjacent to the nut 154 and be configured to interface with a surface of the nut. In the present embodiment, the second bearing 155 is positioned distal to the nut 154. The variable resistance apparatus 140 may further comprise a washer 156 positioned adjacent to and interface with the second bearing 155. In the present embodiment, the washer 156 is positioned distal of the second bearing 155. The variable resistance apparatus 140 may further comprise a third bearing 157 positioned adjacent to and interface with the washer 156. In the present embodiment, the third bearing 157 may be positioned distal of the washer 156. The spring 141 may interface with the third bearing 157, specifically a distal surface of the third bearing 157. Each of the second and third bearings 155, 157 may be configured to permit the nut 154 and the spring 141, respectively, to rotate independently thereof. The washer 156 may provide additional support to the second and third bearings 155, 157 to prevent their buckling.

The second bearing 155, the washer 156, and the third bearing 157 may enable compression of the spring 141 by axial movement of the nut 154, as described above. Specifically, axial movement of the nut 154 may cause axial movement of the second bearing 155, the washer 156, and the third bearing 157 via the interfacing between the nut 154, the second bearing 155, the washer 156, and the third bearing 157. Axial movement of the third bearing 157 may cause the compression or release of compression of the spring 141.

The device 100 may further comprise a measuring member 170. The measuring member 170 may be configured to facilitate measurement of the degree of resistance in the current state of the device 100. In the present embodiment, the measurement member 170 is an elongated member comprising a first end 172, a loopback section 174, an elongate section 176, and a second end 178. The first end 172 may be positioned adjacent to one or more of the second bearing 155, the washer 156, and the third bearing 157. In the present embodiment, the washer 156 may comprise a cutout within which the first end 172 may be positioned, such that the first end is positioned between the second and third bearings 155, 157. The loopback section 174 may comprise a first portion extending distally from the first end 172 and a second portion extending proximally from the first portion. The elongate section 176 may extend distally from the second section of the loopback section 174 to the second end 178. Each of the loopback section 174, the elongate section 176, and the second end 178 may all be positioned within the axial member 110. The first end 172 may extend through an opening of the axial member 110 into the cutout of the washer 156.

The device 100 may further comprise a circuit board 180. The circuit board 180 may comprise circuitry necessary for operation of the device 100. In the present embodiment, the circuit board 180 may comprise a sensor 181. The sensor 181 may be configured to facilitate determination of the resistance of the device 100 in its current state. In the present embodiment, the sensor 181 is a pressure sensor comprising a pressure sensing surface 182. The second end 178 of the measuring member 170 may be positioned adjacent to and interface with the pressure sensing surface 182. As the various components of the variable resistance apparatus 140 translate axially in a distal direction causing the measurement member to also translate distally, the pressure exerted by the second end 178 on the pressure sensing surface 182 will decrease. As the various components of the variable resistance apparatus 140 translate axially in a proximal direction causing the measurement member to also translate proximally, the pressure exerted by the second end 178 on the pressure sensing surface 182 will increase. Other componentry comprised by the circuit board 180, for example, a microcontroller, integrated circuit, or other computing device, may be coupled to the pressure sensor 181 and receive pressure measurements therefrom. The microcontroller may be configured to interpret the pressure measurements received from the pressure sensor 181 and determine a resistance measurement of the current state of the device 100 therefrom, defining a calculated resistance. Decreases in pressure will indicate an increase in resistance, and increases in pressure will indicate a decrease in resistance.

In another embodiment, the sensor 181 may be an optical sensor with an optical sensing surface 182. In such embodiments, the second end 178 may be positioned adjacent to but not touching, the optical sensing surface 182. In such embodiments, as the various components of the variable resistance apparatus 140 translate axially in a distal direction causing the measurement member to also translate distally, the distance between the second end 178 and the optical sensing surface 182 will increase. As the various components of the variable resistance apparatus 140 translate axially in a proximal direction causing the measurement member to also translate proximally, the distance between the second end 178 and the optical sensing surface 182 will decrease. The microcontroller may be configured to interpret the pressure measurements received from the optical sensor 181 and determine a resistance measurement of the current state of the device 100 therefrom. Decreases in distance will indicate decrease in resistance, and increases in distance will indicate an increase in resistance.

The circuit board 180 may further comprise one or more indicator devices 184. The indicator devices 184 may be configured to provide sensory information to the user about the current status of the device. Such information may pertain to the power status of the device (powered on or powered off, for example), and an indication of the resistance state of the device, such as the calculated resistance. The indicator devices 184 may be configured to provide auditory or visual sensory information. In the present embodiment, the indicator devices 184 may be light emitting diodes (LEDs) configured to emit light in one or more colors and to flash in an alternating pattern to further convey information. It is further contemplated and included within the scope of the invention that other devices capable of emitting light may be included, such as, but not limited to, segment display devices, liquid crystal displays (LCDs), and other display devices. Additionally, speaker devices and piezoelectric devices may also be comprised to provide auditory sensory information. The controller may be coupled to the indicator devices 184 and control the operation thereof.

The circuit board 180 may further comprise a power supply 186, such as a battery, to provide electrical power for the operation of the various components of the circuit board. The circuit board 180 may further comprise a communication port 188 operable to connect with an external computerized device to permit data generated by the components of the circuit board 180 to be sent to such a computerized device. Additionally, updates to the devices comprised by the circuit board 180 may also be received via the communication port 188. All types of communication ports as are known in the art are contemplated and included within the scope of the invention, including, but not limited to, Universal Serial Bus (USB) ports. Additionally, the communication port 188 may be configured to enable charging of the power supply 186 by receiving current from Additionally, it is further contemplated and included within the scope of the invention that the circuit board 180 may comprise a wireless communication device operable to communicate wirelessly with a remote computerized device by any wireless standard as is known in the art, including any IEEE 802.xx standard, such as Bluetooth, Wi-Fi, and the like.

Figure 9:
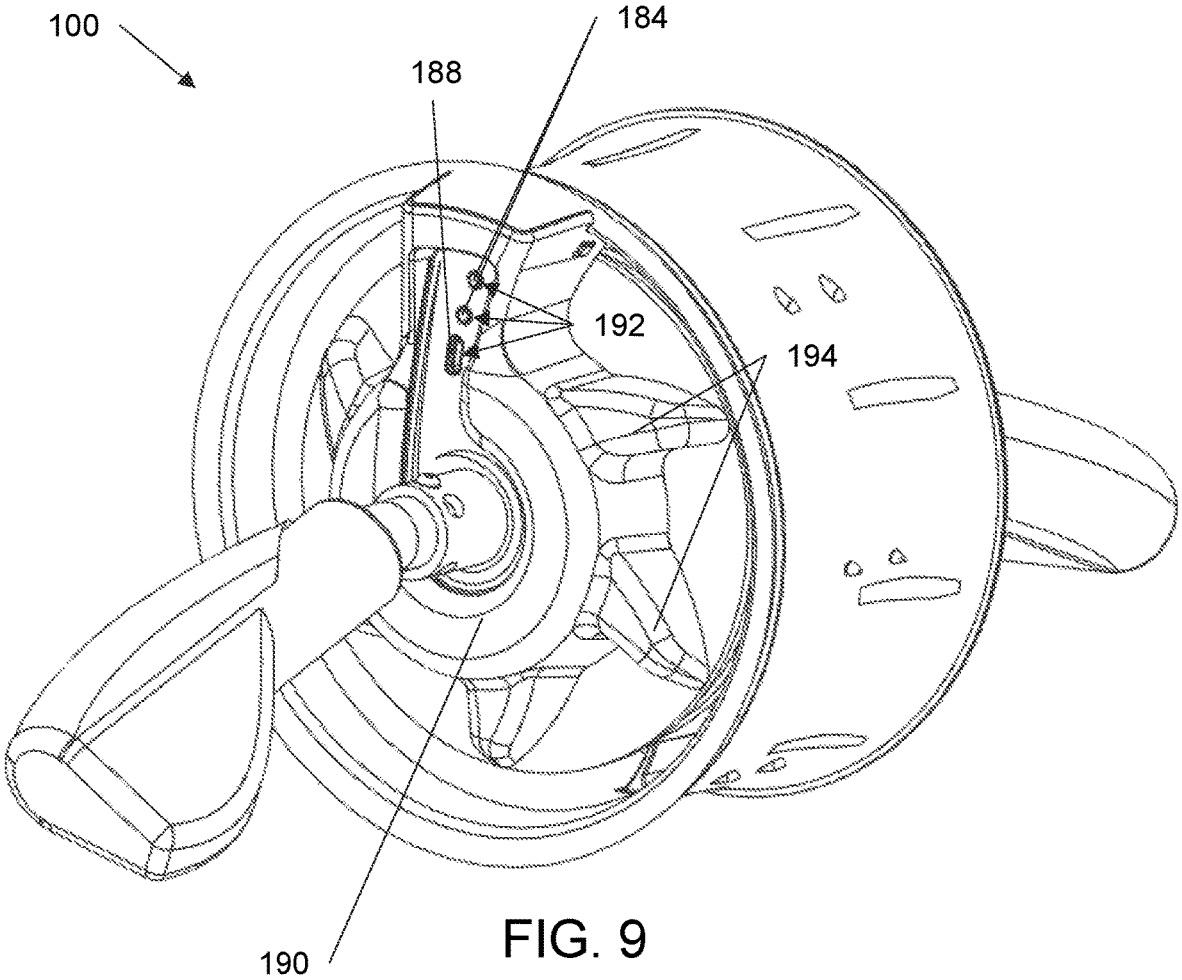
FIG. 9 is a side perspective view of the abdominal exercise device of FIG. 1.

As shown in FIG. 9, the device 100 may further comprise a distal housing 190. The distal housing 190 may be positioned over the circuit board 180 and comprise one or more apertures 192 to allow the indicator devices 184 and the communication port 188 to be perceptible and/or accessible by the user. The distal housing 190 may comprise one or more engagement structures 194 analogous to engagement structures 152.

As mentioned above, the device 100 may comprise opposing handle assemblies 160. Each handle assembly 160 may comprise an intermediate member 162 comprising a first end 164 configured to be attached to the proximal and/or distal end of the axial member 110. Such attachment may be accomplished by any means or method as is known in the art. In the present embodiment, the intermediate member 162 comprises one or more depressible retention members 165 that may de depressed by the user to permit the first end 164 to slide into the proximal or distal end of the axial member and then spring radially outward through the apertures 116 of the axial member, thereby releasably attaching the handle assembly 160 to the axial member 110. The intermediate member 162 may further comprise a second end 166. Each handle assembly 160 may further comprise a handle member 168 attached at the second end 166 of the intermediate member 162. The handle member 168 may be configured to facilitate the user placing their hand or foot thereon to impart a force to the device 100, that force being transmitted through the axial member 110 in the direction of path p, thereby causing rotation of the rotating apparatus 120 as described above. In some embodiments, the device 100 may comprise a first set of handle assemblies configured to be grasped by the user and a second set of handle assemblies configured to interface with the feet of the user, each set of handle assemblies being removably attachable to the axial member 110.

In another embodiment, an abdominal exercise device according to an embodiment of the invention may comprise an electromechanical device operable to control the resistance exerted on the rotating apparatus of the device. Such an embodiment is presented in FIG. 10, wherein a device 200 according to an embodiment of the invention is presented. In this embodiment, the variable resistance apparatus 240 may comprise an electric motor. The motor may be coupled to a flange member 223 of the rotation apparatus 220 of the device 200 and may be configured to provide a resistance to the rotation of the rotation apparatus 220.

Figure 10:
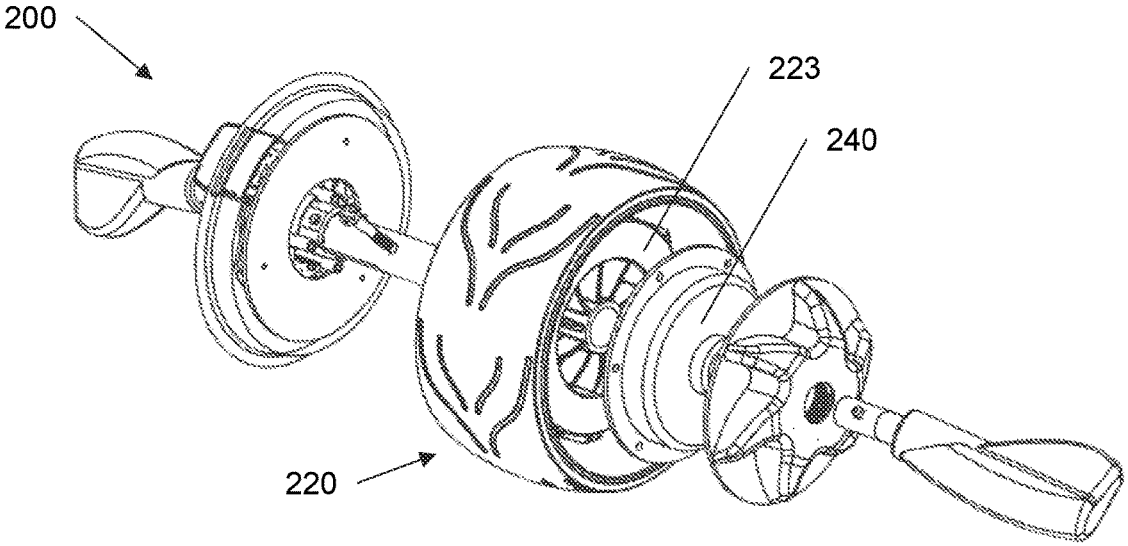
FIG. 10 is a front perspective exploded view of an abdominal exercise device according to an embodiment of the invention.
Figure 11:
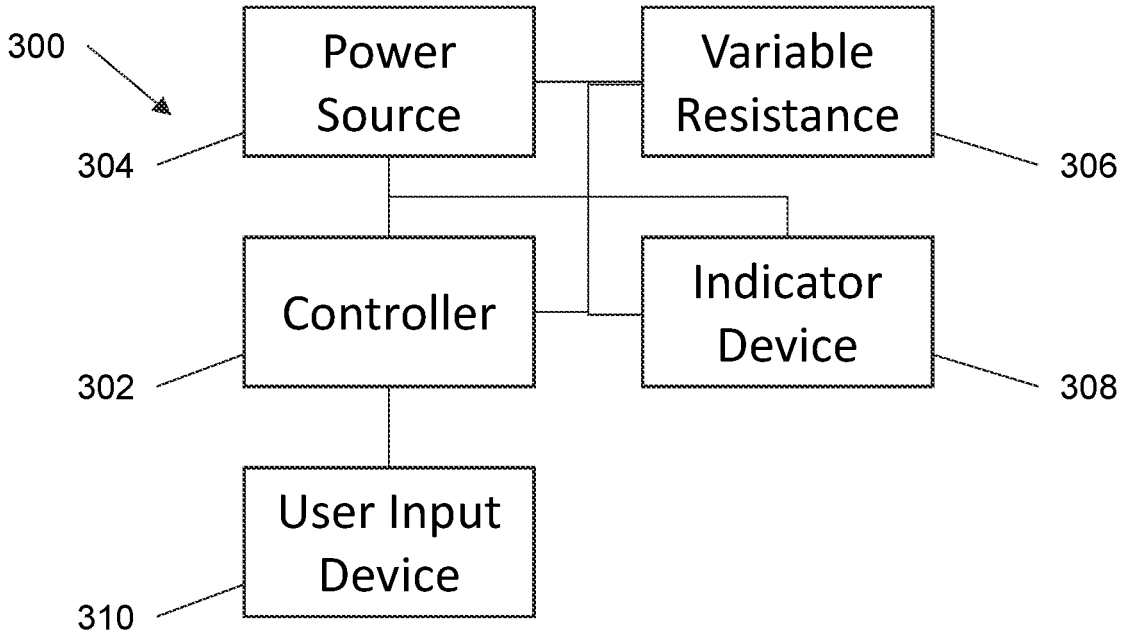
FIG. 11 is a schematic view of a control system of an abdominal exercise device according to an embodiment of the invention.

Referring now to FIG. 11, a control system 300 for an abdominal exercise device according to an embodiment of the invention is presented. As mentioned above, a circuit board associated with a device may comprise electrical componentry to facilitate operation of the device. The control system 300 may comprise a controller 302, a power source 304, a variable resistance apparatus 306, one or more indicator devices 308, and a user input device 310. The controller 302 may be a controller device as mentioned above, including integrated circuits, microprocessors, filed programmable gate arrays, and the like. The power source 304 may be a battery and/or any other source of electrical power as is known in the art. The variable resistance apparatus may be an electromechanical device operable to change the resistance of the device as discussed above. While a motor device is shown in FIG. 10, it is further contemplate and included within the scope of the invention that an electromechanical device operable to selectively compress and release the spring 141 shown in FIGS. 1-9 to change the resistance exerted upon the rotating apparatus 120 thereof. The indicator device 308 may be an indicator device as described above. The user input device 310 may be any type of device operable to receive an input from the user to result in a change of resistance exerted by the variable resistance apparatus 306. Types of user input devices include, but are not limited to, buttons, touchscreens, dials, knobs, and the like. Moreover, the user input device 310 and the indicator device 308 may be a single device in some embodiments.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. An exercise device comprising:

an axial member defining a center axis of a central assembly, the axial member comprising:

a proximal end;

a distal end; and openings at each of the proximal and distal ends;

a rotating apparatus configured to rotate about the center axis and comprising:

a surface interfacing member configured to rotate about the center axis relative to the axial member;

a hub positioned around the axial member; and a plurality of spokes extending from the hub to the surface interfacing member;

a variable resistance apparatus comprising:

a resistance member being singular and configured to exert resistance to the rotation of the rotating apparatus about the axial member; and a user control device operable to change a magnitude of resistance exerted by the variable resistance member; and two handle assemblies positioned on opposite sides of the hub, each handle assembly comprising:

an intermediate member comprising:

a first end attached to one of the proximal and distal ends of the axial member; and a second end; and a handle member attached to the intermediate member at the second end and configured to facilitate a user to use with the exercise device.

2. The exercise device of claim 1 wherein:

the variable resistance apparatus further comprises:

a brake plate positioned on a distal side of the hub and positioned such that the rotating apparatus rotates with respect to the brake plate; and a spring positioned on a proximal side of the hub and operable to exert an axial force on the hub;

the user control device is operable to selectively compress the spring to change a magnitude of the axial force exerted by the spring on the hub; and the rotating apparatus further comprises a brake plate interfacing surface configured to interface with the brake plate and have a frictional force exerted thereon by the brake plate, resisting the rotation of the rotating apparatus.

3. The exercise device of claim 2 further comprising a first bearing positioned between the spring and the hub configured to permit the hub to rotate with respect to the spring while enabling the exertion of the axial force by the spring upon the hub.

4. The exercise device of claim 3 wherein:

the user control device comprises:

a body member configured to be manipulated by the user; and a threaded aperture;

the proximal end of the axial member comprises threads configured to engage with threads of the threaded aperture; and manipulation of the body member by the user causes the threaded aperture to rotate with respect to the axial member, causing axial movement of the body member along the center axis, thereby causing a change in compression of the spring.

5. The exercise device of claim 4 wherein:

the body member comprises a recess; and the threaded aperture is defined by a nut positioned within the recess of the body member such that rotation of the body member causes rotation of the nut.

6. The exercise device of claim 5 wherein:

the variable resistance apparatus further comprises:

a second bearing positioned adjacent to and distal to the nut and configured to interface with a surface of the nut;

a washer positioned adjacent to and distal to the second bearing; and a third bearing positioned adjacent to and distal to the washer;

wherein the spring interfaces with the third bearing; and the second bearing, the washer, and the third bearing enable the compression of the spring by axial movement of the nut while permitting rotation of the nut about the center axis at least partially independent of the spring.

7. The exercise device of claim 6 further comprising:

a sensor positioned on a distal side of the central assembly; and a measuring member configured to interface with a structure on a proximal side of the central assembly on a first end thereof and interact with the sensor on a second end thereof;

wherein the first end of the measuring member is axially translated by the movement of the body member; and wherein the movement of the first end of the measuring member causes an effect in the second end of the measuring member that is detectable by the sensor.

8. The exercise device of claim 7 further comprising:

a controller positioned in communication with the sensor; and an indicator device positioned in communication with the controller;

wherein the sensor is a pressure sensor comprising a pressure sensing surface;

wherein the pressure sensor is configured to transmit a signal to the controller responsive to a measured pressure on the pressure sensing surface;

the second end of the measuring member is configured to interface the pressure sensing surface and exert a force thereon;

a magnitude of the force exerted by the measuring member on the pressure sensor changes with the axial translation of the first end of the measuring member;

the controller is configured to:

calculate a calculated resistance being exerted on by the variable resistance apparatus responsive to the signal received from the pressure sensor;

and operate the indicator device to provide an indication of the calculated resistance.

9. The exercise device of claim 2 wherein the user control device further comprises:

a user input interface configured to receive a user input selecting a desired resistance;

an electromechanical device operable to compress the spring; and a controller coupled to each of the user input interface and the electromechanical device and operable to:

receive the user input from the user input interface;

determine a spring compression amount responsive to the user input; and operate the electromechanical device to compress the spring to the spring compression amount.

10. The exercise device of claim 9 wherein:

the user control device further comprises:

a body member configured to be manipulated by the electromechanical device; and a threaded aperture;

the proximal end of the axial member comprises threads configured to engage with threads of the threaded aperture; and manipulation of the body member by the electromechanical device causes the threaded aperture to rotate with respect to the axial member, causing axial movement of the body member along the center axis, thereby causing a change in the compression of the spring.

11. The exercise device of claim 9 wherein the electromechanical device is a linear actuator configured to selectively compress the spring along the central axis.

12. The exercise device of claim 1 wherein the surface interfacing member comprises:

an interior surface structure connected to the spokes; and an outer surface member attached to and supported by the interior surface structure and formed of a rubber material.

13. The exercise device of claim 1 wherein:

the resistance member comprises:

an electric motor having a rotor configured to engage with the hub, the electric motor being operable to exert a force on the hub via the rotor to resist rotation of the hub; and a power source configured to provide power to the electric motor to enable operation of the electric motor; and the user control device comprises a user interface operable to control the operation of the electric motor.

14. The exercise device of claim 1 wherein the handle member is a first handle member configured to be removably attached at the second end and to facilitate the user grasping the first handle member, the exercise device further comprising a second handle member configured to be removably attached at the second end and to support a foot of the user.

15. The exercise device of claim 1 further comprising:

a power source;

a light source coupled to the power source and configured to be energized by the power source; and a controller coupled to each of the power source and the light source and configured to be energized by the power source and to operate the light source responsive to at least one of a power level of the power source, a characteristic of operation of the exercise device, and music being played in association with the user's use of the exercise device;

wherein the controller is operable to receive an input providing information about the power level of the power source, the characteristic of operation of the exercise device, and the music being played in association with the user's use of the exercise device.

16. An exercise device comprising:

an axial member defining a center axis of a central assembly, the axial member comprising:

a proximal end;

a distal end; and openings at each of the proximal and distal ends;

a rotating apparatus configured to rotate about the center axis and comprising:

a surface interfacing member configured to rotate about the center axis relative to the axial member and comprising a rubber outer surface member configured to interface with an environmental surface;

a hub positioned around the axial member;

a plurality of spokes extending from the hub to the surface interfacing member; and a brake plate interfacing surface;

a variable resistance apparatus, comprising:

a brake plate positioned on a distal side of the hub and positioned such that the rotating apparatus rotates with respect to the brake plate and interfaces with the brake plate interfacing surface and exerts a frictional force thereon, resisting rotation of the rotating apparatus;

a spring positioned on a proximal side of the hub and operable to exert an axial force on the hub; and a user control device operable to selectively compress the spring to change a magnitude of the axial force exerted by the spring on the hub; and two handle assemblies positioned on opposite sides of the hub, each handle assembly comprising:

an intermediate member comprising:

a first end attached to one of the proximal and distal ends of the axial member; and a second end; and a handle member attached to the intermediate member at the second end and configured to facilitate a user to use with the exercise device.

17. The exercise device of claim 16 wherein:

the user control device comprises:

a body member configured to be manipulated by the user and comprising a recess; and a threaded nut positioned within the recess of the body member such that rotation of the body member causes rotation of the threaded nut, and the proximal end of the axial member comprises threads configured to engage with threads of the threaded nut; and manipulation of the body member by the user causes the threaded out to rotate with respect to the axial member, causing axial movement of the body member along the center axis, thereby causing a change in compression of the spring.

18. The exercise device of claim 16 wherein the handle member is a first handle member configured to be removably attached at the second end and to facilitate the user grasping the first handle member, the exercise device further comprising a second handle member configured to be removably attached at the second end and to support a foot of the user.

19. An exercise device comprising:

an axial member defining a center axis of a central assembly, the axial member comprising:

a proximal end;

a distal end; and openings at each of the proximal and distal ends;

a rotating apparatus configured to rotate about the center axis and comprising:

a surface interfacing member configured to rotate about the center axis relative to the axial member and comprising a rubber outer surface member configured to interface with an environmental surface;

a hub positioned around the axial member; and a plurality of spokes extending from the hub to the surface interfacing member;

a variable resistance apparatus, comprising:

an electric motor having a rotor configured to engage with the hub, the electric motor being operable to exert a force on the hub via the rotor to resist rotation of the hub;

a power source configured to provide power to the electric motor to enable operation of the electric motor; and a user interface operable to control the operation of the electric motor to selectively increase or decrease resistance exerted by the electric motor to the rotation of the rotating apparatus; and two handle assemblies positioned on opposite sides of the hub, each handle assembly comprising:

an intermediate member comprising:

a first end attached to one of the proximal and distal ends of the axial member; and a second end; and a handle member attached to the intermediate member at the second end and configured to facilitate a user to use with the exercise device.

20. The exercise device of claim 19 wherein the handle member is a first handle member configured to be removably attached at the second end and to facilitate the user grasping the first handle member, the exercise device further comprising a second handle member configured to be removably attached at the second end and to support a foot of the user.

* * * * *